US008505836B2

(12) United States Patent
Mayher

(10) Patent No.: US 8,505,836 B2
(45) Date of Patent: Aug. 13, 2013

(54) WATER SPRINKLER

(75) Inventor: Joseph E. Mayher, Chillicothe, IL (US)

(73) Assignee: Robert Bosch GmbH, Stuttgart (DE)

( * ) Notice: Subject to any disclaimer, the term of this patent is extended or adjusted under 35 U.S.C. 154(b) by 784 days.

(21) Appl. No.: 12/726,990

(22) Filed: Mar. 18, 2010

(65) Prior Publication Data

US 2011/0226867 A1 Sep. 22, 2011

(51) Int. Cl.
*B05B 1/00* (2006.01)

(52) U.S. Cl.
USPC ..... 239/600; 239/70; 239/240; 239/242; 239/261

(58) Field of Classification Search
USPC ..... 239/70, 261, 263, 263.3, 240, 242, 239/600
See application file for complete search history.

(56) References Cited

U.S. PATENT DOCUMENTS 3,567,122 A 3/1971 Congdon et al.
4,625,914 A 12/1986 Sexton et al.
4,860,954 A * 8/1989 Allemann ..... 239/101
5,350,115 A 9/1994 Burnworth et al.
5,749,524 A * 5/1998 Roman ..... 239/240
7,226,000 B2 * 6/2007 Huang ..... 239/242
7,494,071 B2 2/2009 Baird
2002/0130204 A1 9/2002 Chao
2010/0012749 A1 1/2010 Barzuza

* cited by examiner

*Primary Examiner* — Dinh Q Nguyen
(74) *Attorney, Agent, or Firm* — Maginot, Moore & Beck

(57) ABSTRACT

A water sprinkler includes a base, a timer mechanism having a timer inlet and a timer outlet, the timer mechanism being configured to operate in (i) a first mode in which fluid is allowed to pass between the timer inlet and the timer outlet, and (ii) a second mode in which fluid is prevented from passing between the timer inlet and the timer outlet, a motor having a motor inlet, a motor outlet, and a drive member, the motor configured to move the drive member in response to fluid passing from the motor inlet to the motor outlet, and a spray member coupled to the motor outlet, the spray member configured to move in response to movement of the drive member, wherein the base includes a first base retention structure and a second base retention structure.

12 Claims, 10 Drawing Sheets

WATER SPRINKLER

FIELD OF THE INVENTION

The present disclosure generally relates to water sprinklers.

BACKGROUND OF RELATED ART

Water sprinklers are used to distribute water within a spray area, such as a lawn. There are numerous forms of water sprinklers, including stationary, rotary, and oscillating varieties. In general, each form of water sprinkler is fluidly coupled to a water supply through a water supply conduit, such as a garden hose. Stationary water sprinklers distribute water through a stationary water distributor, such as a stationary spray tube or other spray member. The spray tube includes numerous nozzles, each of which are positioned to eject a stream of water onto a region within the spray area. The size of the spray area is determined, in part, by the number of nozzles on the spray tube and the pressure of the water supply to which the water sprinkler is coupled. Rotary and oscillating water sprinklers include a water distributor that rotates or oscillates in order to distribute water within a greater area than would otherwise be possible with a stationary distributor. The flow of the water supply provided to a rotary and an oscillating sprinkler is used to drive a water motor which moves the water distributor.

There is a continuing need in the art to provide a water sprinkler that is less complicated to manufacture.

SUMMARY

In accordance with one embodiment of the present disclosure, there is provided a water sprinkler that includes a base, a timer mechanism having a timer inlet and a timer outlet, the timer mechanism being configured to operate in (i) a first mode in which fluid is allowed to pass between the timer inlet and the timer outlet, and (ii) a second mode in which fluid is prevented from passing between the timer inlet and the timer outlet, a motor having a motor inlet, a motor outlet, and a drive member, the motor configured to move the drive member in response to fluid passing from the motor inlet to the motor outlet, and a spray member coupled to the motor outlet, the spray member configured to move in response to movement of the drive member, wherein the base includes a first base retention structure and a second base retention structure, wherein the timer mechanism includes a timer retention structure configured to cooperate with the first base retention structure to create a first snap-fit connection between the timer mechanism and the base, wherein the motor includes a motor retention structure configured to cooperate with the second base retention structure to create a second snap-fit connection between the motor and the base, wherein the timer outlet defines a first coupling component, and wherein the motor inlet defines a second coupling component configured to mate with the first coupling component.

In accordance with another embodiment of the present disclosure, there is provided a method of manufacturing a water sprinkler having a base, a timer mechanism and a motor including (a) mating a first coupling component of the timer mechanism with a second coupling component of the motor to form a fluid-tight connection therebetween; and (b) snap-fitting the timer mechanism and the motor to the base after step (a).

BRIEF DESCRIPTION OF THE FIGURES

Features of the present invention will become apparent to those of ordinary skill in the art to which this device pertains from the following description with reference to the figures, in which.

DETAILED DESCRIPTION

For the purpose of promoting an understanding of the principles of the device described herein, reference will now be made to the embodiment(s) illustrated in the figures and described in the following written specification. It is understood that no limitation to the scope of the device is thereby intended. It is further understood that the device includes any alterations and modifications to the illustrated embodiment (s) and includes further applications of the principles of the device as would normally occur to one of ordinary skill in the art to which this device pertains.

Figure 1:
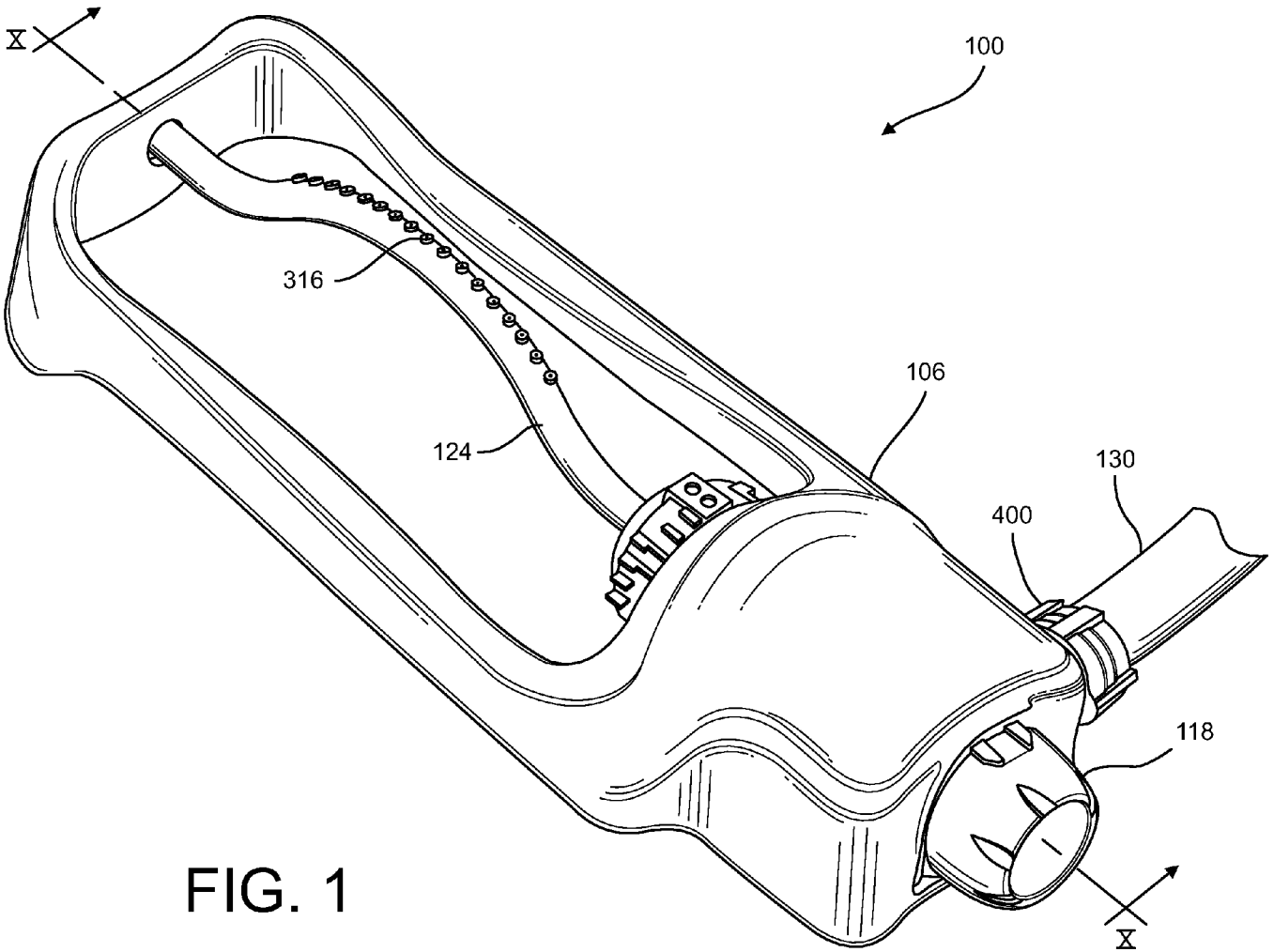
FIG. 1 is a perspective view of a water sprinkler according to the present disclosure.

A water sprinkler 100, shown in FIG. 1, distributes water within a predetermined area. The water sprinkler 100 includes a base 106, a water motor 112 (FIG. 2), a timer mechanism 118, and a distributor 124. The water motor 112 and the timer mechanism 118 are connected to an underside of the base 106. The timer 118 is connected to a water supply conduit, such as a garden hose 130 connected to a spigot, and is configured to regulate a flow of water to the motor 112. A fluid output of the motor 112 is coupled to the distributor 124, and a mechanical output of the motor is connected to the distributor 124. In response to the water sprinkler 100 being supplied with a flow of water and the timer 118 being in an "on" mode, the motor 112 moves the distributor 124 in a repeating path of movement and the distributor distributes water onto the predetermined area through the outlets 316. In response to the timer mechanism 118 being in an "off" mode, the distributor 124 remains stationary and the timer 118 prevents water from being distributed onto the predetermined area.

Figure 2:
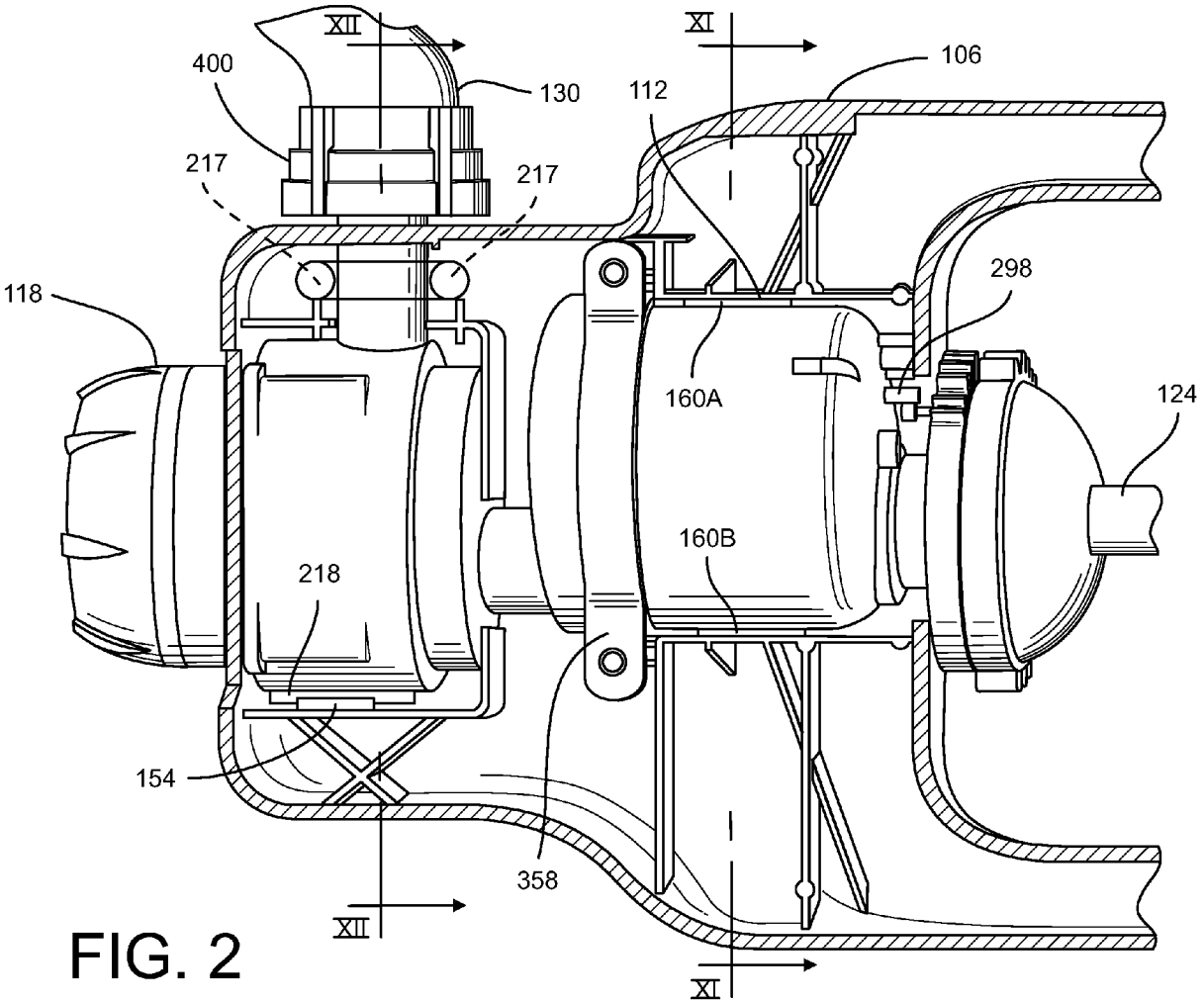
FIG. 2 is a bottom plan view of a portion of the water sprinkler of FIG. 1.
Figure 3:
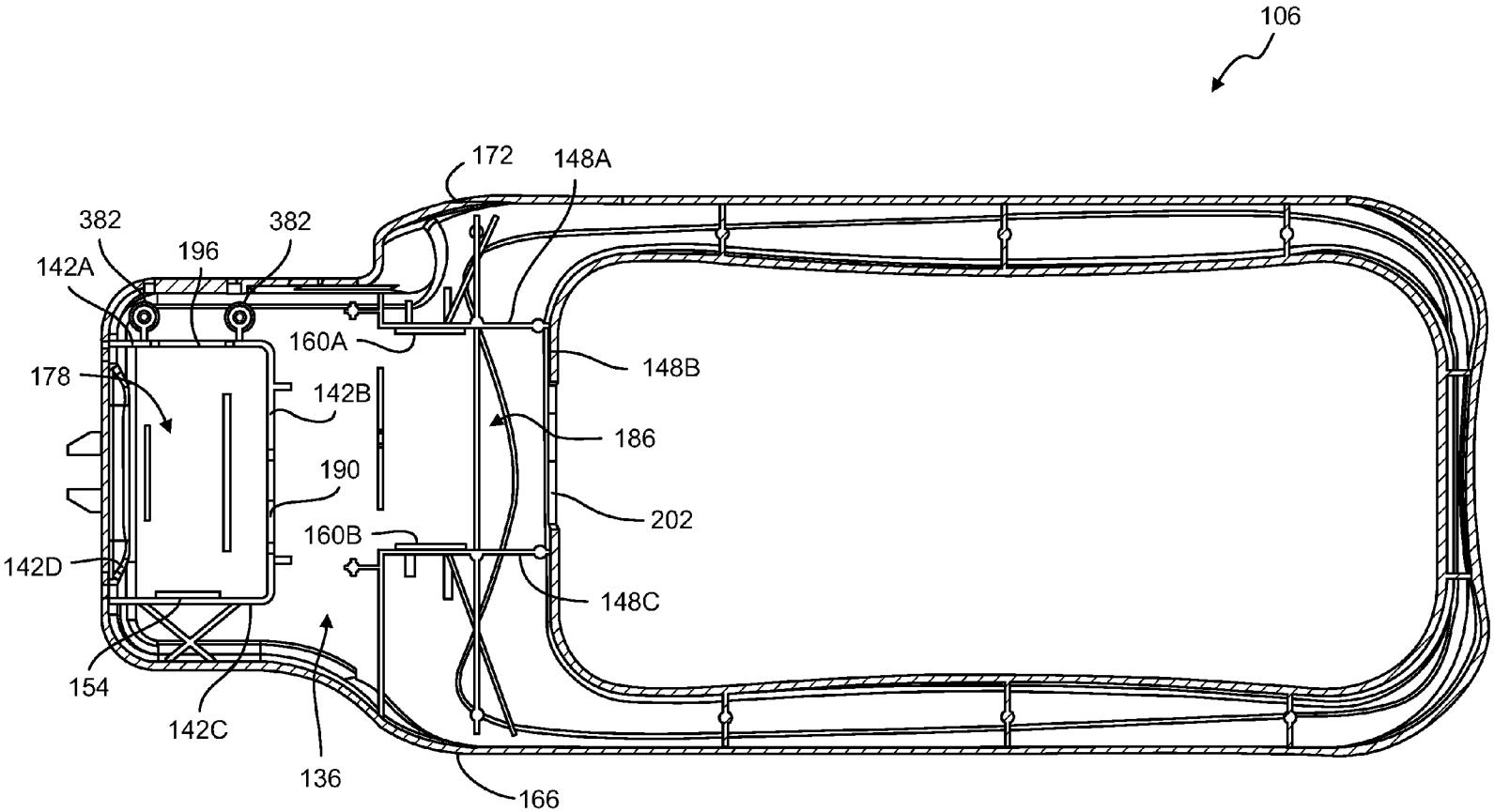
FIG. 3 is a bottom plan view of a base of the water sprinkler of FIG. 1, with a timer mechanism, a water motor, and a distributor of the water sprinkler being removed therefrom for clarity of description.

As shown in FIG. 3, the base 106 includes a cavity 136; partition walls 142A, 142B, 142C, 142D, 148A, 148B, 148C; and retention structures 154, 160A, 160B. The base 106 is formed from an injection moldable thermoplastic material, and defines the cavity 136, which generally extends longitudinally from at least the partition wall 142D to the partition wall 148B and widthwise from an edge 166 to another edge 172. The partition walls 142A, 142B, 142C, 142D, 148A, 148B, 148C are located within the cavity 136 and are configured to define a sub-cavity 178 and a sub-cavity 186. Specifically, a first set of partition walls including the partition walls 142A, 142B, 142C, 142D define the sub-cavity 178, in which the timer mechanism 118 is at least partially positioned (see FIG. 2), and a second set of partition walls including the partition walls 148A, 148B, 148C define the sub-cavity 186, in which the motor 112 is at least partially positioned (see FIG. 2). The partition wall 142B faces the motor 112 and defines a passage 190, which allows access between the sub-cavity 178 and the sub-cavity 186. The partition wall 142A faces the garden hose 130 (FIG. 1) and defines a passage 196. Similarly, the partition wall 148B faces the distributor 124 and defines a passage 202. The retention structure 154 is a portion of the partition wall 142C, and the retention structures 160A, 160B are respective portions of the partition walls 148A, 148C.

Figure 4:
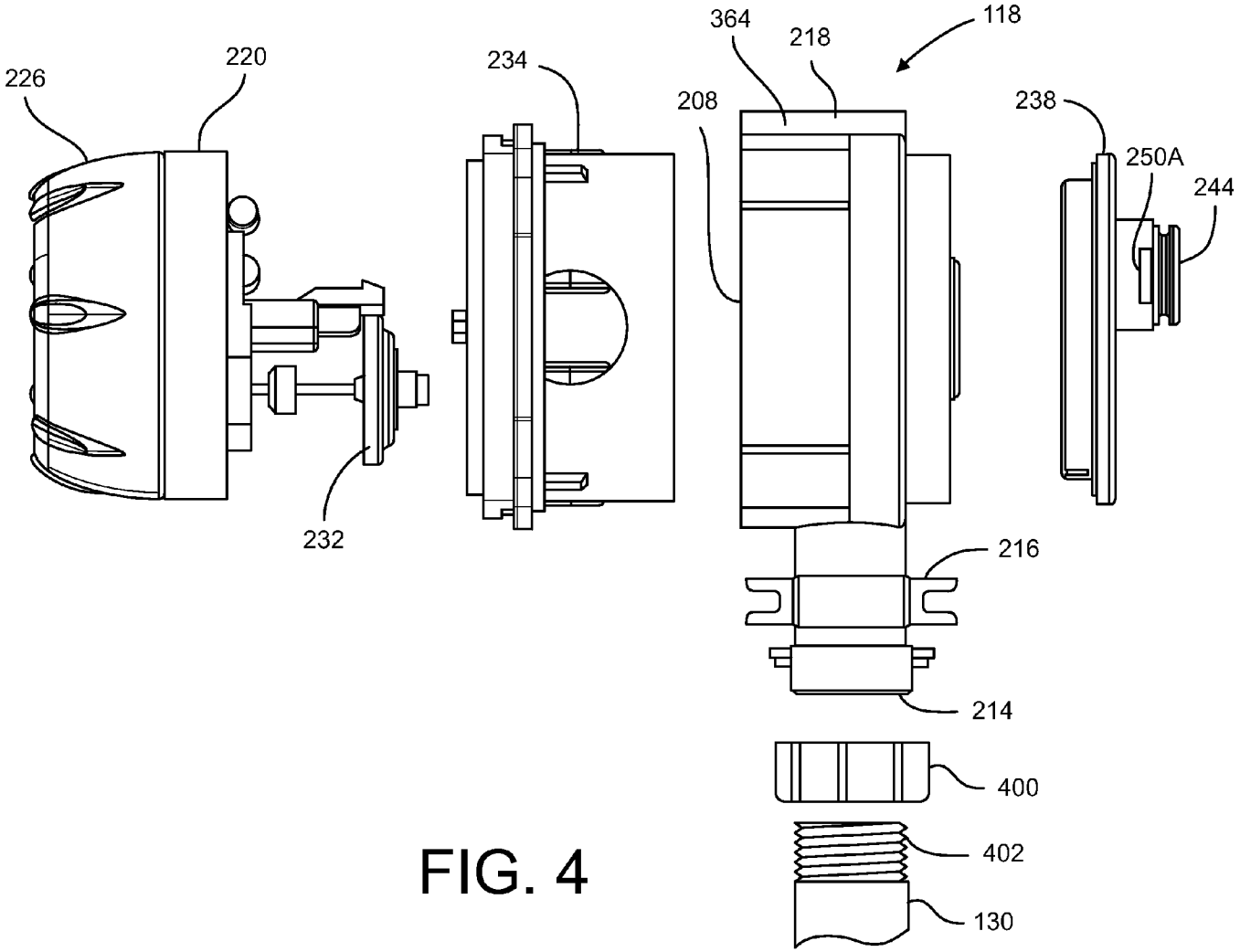
FIG. 4 is an exploded view of the timer mechanism of FIG. 1.

As shown in FIG. 4, the timer 118 includes an inlet structure 208 having an inlet 214, a coupler 216, a retention structure 218 (see also FIG. 12), and a threaded coupling 400; a timing mechanism 220 having a dial 226 and a diaphragm 232; a diaphragm housing 234; and an end cap 238 defining an outlet 244. The timing mechanism 220 is connected to the diaphragm housing 234 to position selectively the diaphragm 232 against structure defining a diaphragm opening (not illustrated) of the diaphragm housing 234. The diaphragm housing 234 is received by and is connected to one side of the inlet structure 208. The end cap 238 is received by and is connected to an opposite side of the inlet structure 208. The coupler 216 connects a portion of the inlet structure 208 to the base 106 (FIG. 2). The retention structure 218 cooperates with the retention structure 154 to create a snap-fit connection between the timer 118 to the base 106. The threaded coupling 400 is rotatably connected to the inlet 214 and is connectable to a threaded end portion 402 of the garden hose 130.

The timer 118 regulates the flow of water from the inlet 214 to the outlet 244. In particular, the dial 226 may be rotated to a select a predetermined time period. For the duration of the predetermined time period, the timer 118 remains in an "on" mode in which the timing mechanism 220 positions the diaphragm 232 away from the diaphragm opening to fluidly couple the inlet 214 to the outlet 244. In the "on" mode the timer 118 enables water from the garden hose 130 to flow from the inlet 214 to the outlet 244. After the predetermined time period expires, the timer 118 enters an "off" mode in which the timing mechanism 234 positions the digraph 232 against the structure of the diaphragm opening to decouple the inlet 214 from the outlet 244. In the "off" mode the timer 118 prevents the flow of water from the inlet 214 to the outlet 244. The timer 118 is not limited to the exemplary embodiment illustrated in FIG. 4; instead, the timer 118 may be any device or apparatus that selectively couples an inlet to an outlet in response to the state or mode of a timing device. The general operation and configuration of water timers are well known to those of ordinary skill in the art.

Figure 5:
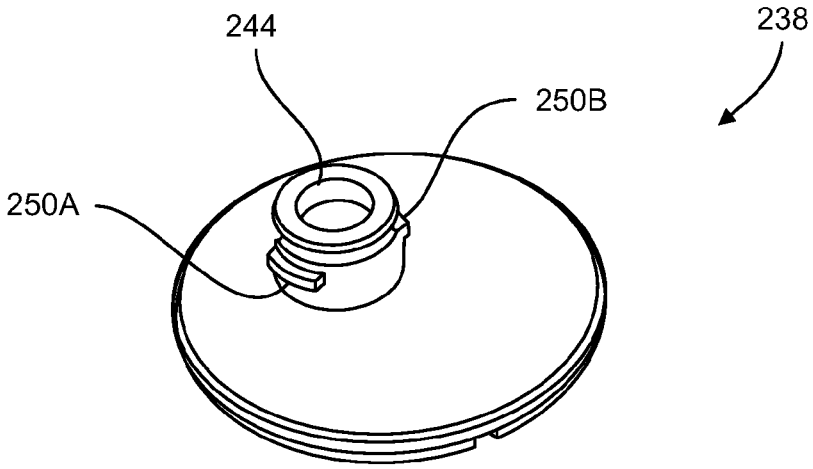
FIG. 5 is a perspective view of an end cap of the timer mechanism of FIG. 4.
Figure 6:
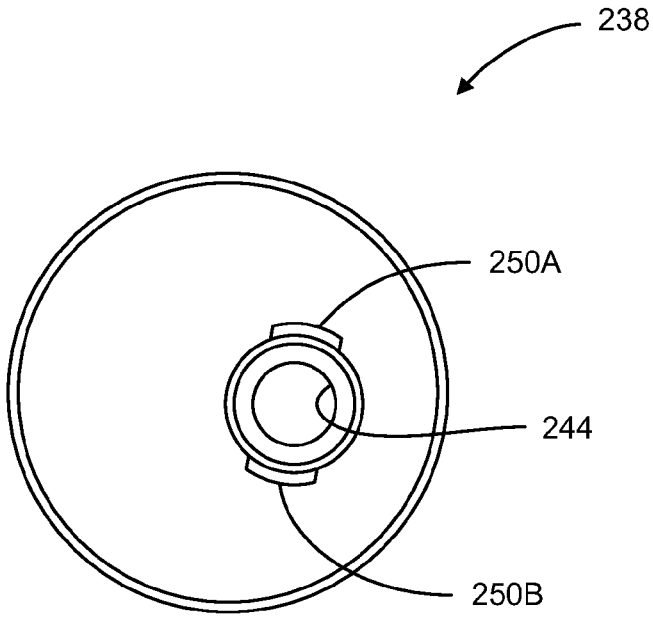
FIG. 6 is a side elevational view of the end cap of FIG. 5.

As shown in FIGS. 5 and 6, the outlet 244 of the end cap 238 includes a coupling component having a connection tab 250A and a connection tab 250B positioned upon an outer cylindrical surface of the outlet 244. The connection tab 250A is approximately diametrically opposite the connection tab 250B. The coupling component of the outlet 244 extends through the passage 190 (FIG. 3) in the partition wall 142B so that the connection tabs 250A, 250B are operable to secure mechanically and fluidly the timer 118 to the motor 112.

Figure 7:
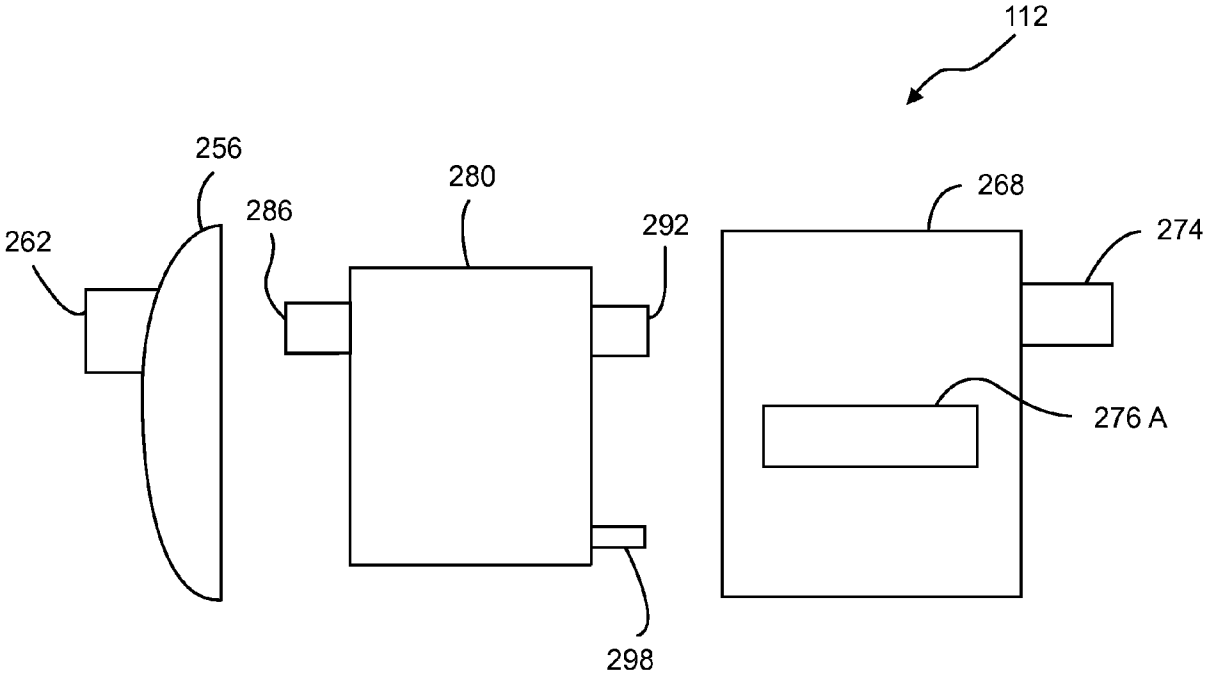
FIG. 7 is an exploded view of the water motor of the water sprinkler of FIG. 1.
Figure 11:
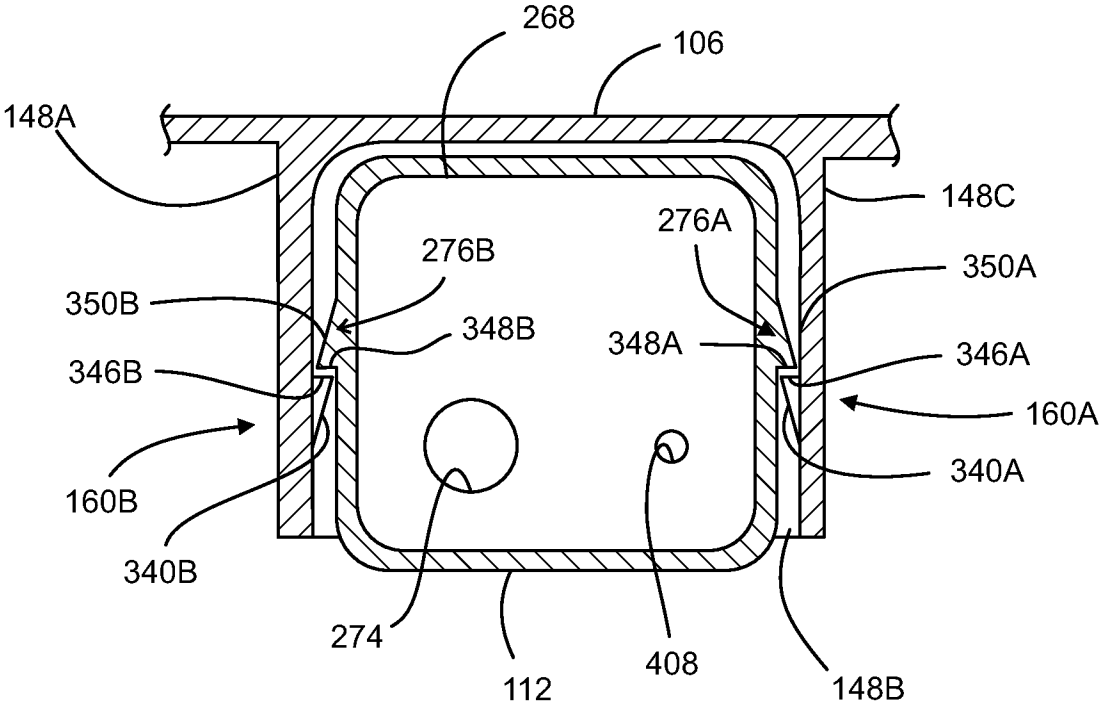
FIG. 11 is a fragmentary cross sectional view taken along line XI-XI of FIG. 2.

As shown in FIG. 7, the motor 112 includes an end cap 256 defining an inlet 262; a casing 268 having an outlet 274 and retention structures 276A, 276B (FIG. 11); and a motor mechanism 280 having an inlet 286, an outlet 292, and a drive member 298. The casing 268 receives the motor mechanism 280 such that the outlet 292 extends through the outlet 274 and the drive member 298 extends through the outlet 408 (FIG. 11). The end cap 256 is connected to the casing 268 to enclose the motor mechanism 280 within the casing 268 and to align the inlet 262 with the inlet 286.

As shown in FIG. 11, each retention structure 276A, 276B of the motor 112 includes a ridge 348A, 348B and a ramp 350A, 350B. The ramps 350A, 350B protrude at an angle from the casing 268, and the ridges 348A, 348B extend approximately perpendicularly from the casing 268. The retention structures 276A, 276B cooperate with a respective one of the retention structures 160A, 160B to create a snap-fit connection between the motor 112 and the base 106. Alternatively, the water sprinkler 100 may include retention structures having a different configuration, which create a secure snap-fit attachment between the motor 112 and the base 106.

The water motor 112 moves the drive member 298 in response to the flow of water through the motor 112. The motor mechanism 280 includes an intermediate element (not illustrated) which rotates in response to the flow of water from the inlet 262 to the outlet 274. Rotation of the intermediate element causes the drive member 298 to oscillate. In an alternative embodiment, rotation of the intermediate element causes the drive member 298 to rotate or reciprocate. Water exiting the motor 112 flows through the outlets 292, 274. The motor 112 is not limited to the exemplary embodiment illustrated in FIG. 7; instead, the motor 112 may be any device or apparatus that rotates, reciprocates, and/or oscillates a drive member in response to a flow of water from an input to an output of the motor. The general operation and configuration of sprinkler water motors are well known to those of ordinary skill in the art.

Figure 9:
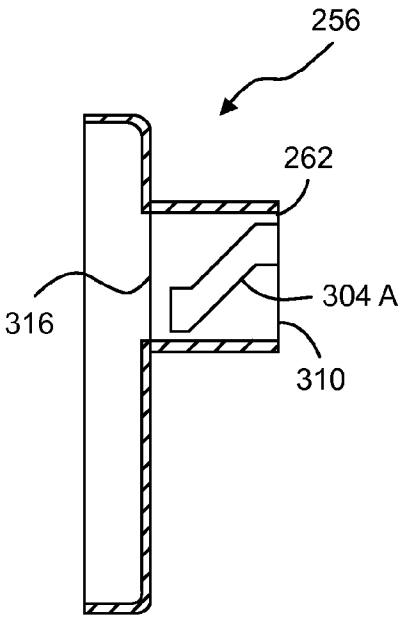
FIG. 9 is a cross sectional view taken along line IX-IX of FIG. 8.
Figure 8:
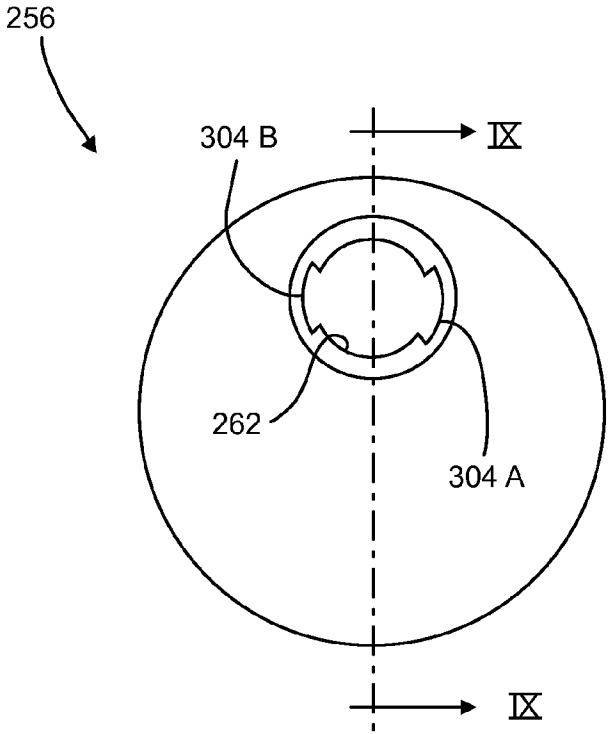
FIG. 8 is a side elevational view of an end cap of the water motor of FIG. 7.

As shown in FIGS. 8 and 9, the inlet 262 of the end cap 256 includes a coupling component defining a slot 304A and a slot 304B, which are configured to mate with the coupling component of the outlet 244. The slots 304A, 304B, which are each configured to receive a respective one of the tabs 250A, 250B, have a width (measured circumferentially) that is approximately the same as a width of the tabs. As shown in FIG. 9, the slot 304A commences at an edge portion 310 of the inlet 262 and terminates near another edge portion 316 of the inlet 262. The slot 304A extends circumferentially and longitudinally leftward on an interior portion of the inlet 262. The slot 304B mirrors the slot 304A on a diametrically opposite side of the inlet 262.

The outlet 244 of the timer 118 may be connected to the inlet 262 of the motor 112 by aligning the tabs 250A, 250B with the slots 304A, 304B. Next, the timer 118 is rotated in a clockwise direction approximately ninety degrees (90°), which causes the tabs 250A, 250B to slide toward the edge 316 as guided by the slots 304A, 304B. When the tabs 250A, 250B are positioned in the region of the slots 304A, 304B nearest to the edge 316, they become seated within the slots such that the outlet 244 of the timer 118 is fluidly connected to the inlet 262 of the motor 112. After the tabs 250A, 250B become seated in the slots 304A, 304B, the timer 118 is "permanently" connected to the motor 112, such that the timer 118 may not be disconnected from the motor 112 without damaging one of the outlet 244 and the inlet 262. The slots

304A, 304B are at least partially located in the passage 190 when the timer 118 and the motor 112 are connected to the base 106.

Figure 10:
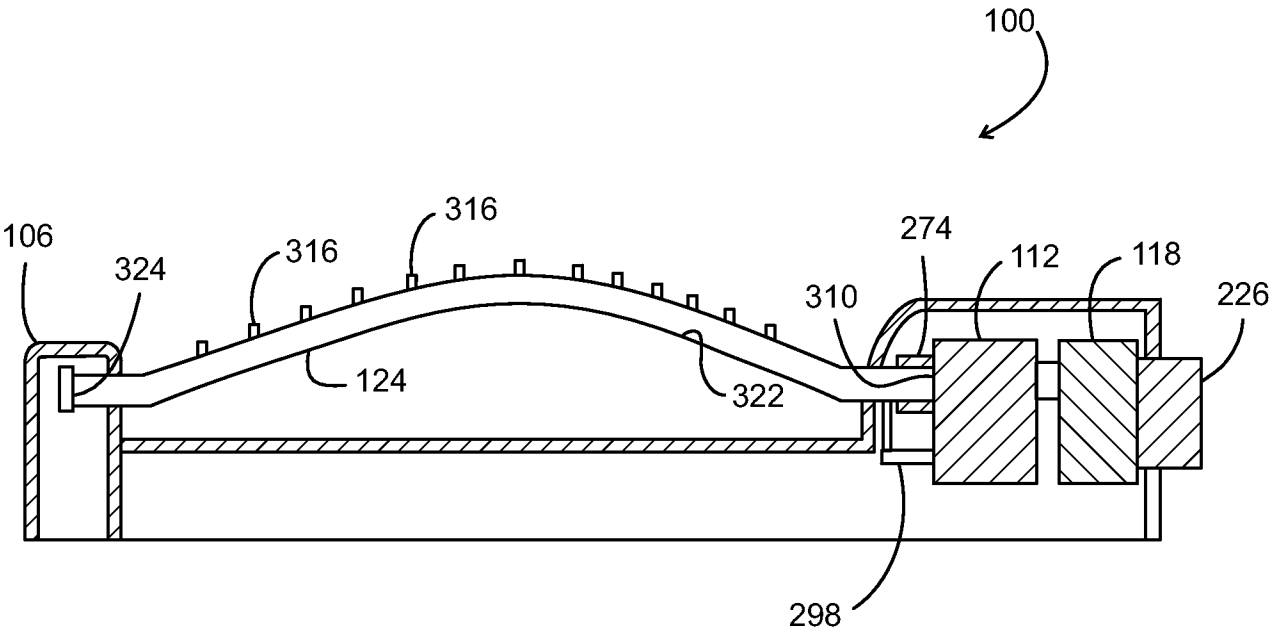
FIG. 10 is a cross sectional view taken along line X-X of FIG. 1.

As shown in FIG. 10, the distributor 124, which may also be referred to as a spray tube or spray member, includes an inlet 310 fluidly coupled to numerous outlets 316 through a channel 322. An end portion 324 of the distributor 124 is supported by the base 106 and is configured to oscillate relative to the base 106. Additionally, the end portion 324 is closed to terminate the channel 322. An end of the distributor 124 nearest the inlet 310 is mechanically connected to the drive member 298, such that the distributor 124 moves with the drive member 298. The inlet 310 is fluidly coupled to the motor 112 to receive water exiting the motor 112 through the outlet 274.

The distributor 124 distributes water onto the predetermined area in response to the timer 118 being connected to the source of water and the timer 118 being in the "on" mode. Water exiting the motor 112 through the outlet 274 flows through the inlet 310 and into the channel 322. Thereafter, the water flows through the outlets 316 and onto the predetermined area.

As shown in FIG. 11, the retention structures 160A, 160B of the base 106 include a ramp 340A, 340B and a ridge 346A, 346B. The ramps 340A, 340B protrude at an angle from a respective one of the partition walls 148A, 148C, and the ridges 346A, 346B extend approximately perpendicularly from a respective one of the partition walls 148A, 148C. When the motor 112 is connected to the base 106, the ridges 346A, 346B are approximately parallel to the ridges 348A, 348B. Alternatively, the water sprinkler 100 may include retention structures having a different configuration, which create a secure snap-fit attachment between the motor 112 and the base 106, and between the timer 118 and the base 106.

Each of the retention structures 276A, 276B, are configured to engage a respective one of the retention structures 160A, 160B, to connect the motor 112 to the base 106. A snap-fit connection occurs between the motor 112 and the base 106 as the motor 112 is moved upward into the empty sub-cavity 186. In particular, as the motor 112 is moved into the sub-cavity 186, the ramps 350A, 350B contact the ramps 340A, 340B. As shown in FIG. 11, upward movement of the motor 112 causes the ramps 350A, 350B to abut the ramps 340A, 340B and bow outward the partition walls 148A, 148C as the ramps 350A, 350B slide upward on the ramps 340A, 340B. In response to the ridges 348A, 348B being positioned above the ridges 346A, 346B, the resilient partition walls 148A, 148B rebound to the position of FIG. 11, such that the ridges 346A, 346B overlap the ridges 348A, 348B to create the snap-fit connection between the motor 112 and the base 106. Referring again to FIG. 2, a supplemental coupler 358 is provided to further secure the motor 112 to the base 106.

A downward force exerted on the motor 112, when the motor 112 is connected to the base 106, does not separate the motor 112 from the base 106, because the partition walls 148A, 148C remain stationary in response to the downward force. In particular, the downward force causes the ridges 348A, 348B to abut the ridges 346A, 346B, and because the ridges 346A, 346B, 348A, 348B are parallel to each other, a vertical downward force is transmitted to the partition walls 148A, 148B, which does not bow outward the partition walls 148A, 148B. Accordingly, the connection between the motor 112 and the base 106 is "permanent", in that the motor 112 may not be removed from the base 106 without damaging one of the motor 112 the base 106. Alternatively, the partition walls 148A, 148B may include release tabs (not illustrated) for withdrawing the retention structures 160A, 160B from the retention structures 276A, 276B to enable the motor 112 to be removed from the base 106.

Figure 12:
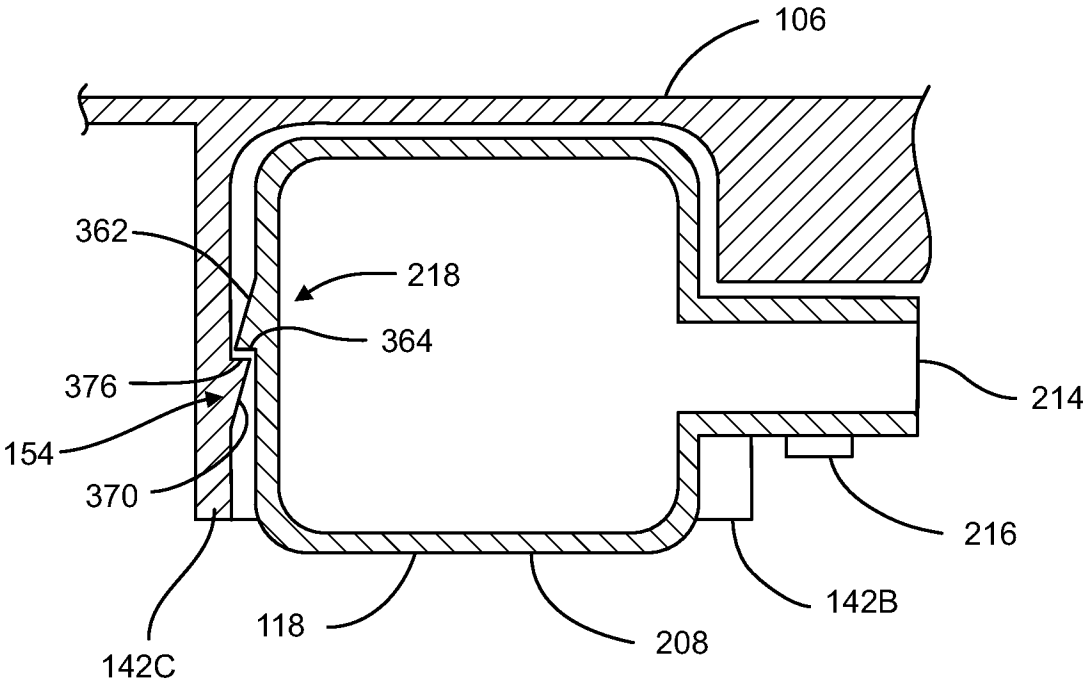
FIG. 12 is a cross sectional view taken along line XII-XII of FIG. 2.

As shown in FIG. 12, the retention structure 218 of the timer 118 engages the retention structure 154 of the partition wall 142C in the same manner that the retention structures 276A, 276B engage the retentions structures 160A, 160B. Specifically, the retention structure 218 includes a ramp 362 and a ridge 364 and the retention structure 154 includes a ramp 370 and a ridge 376. As the timer 118 is moved upward into the empty sub-cavity 178, the partition wall 142C bows outward as the ramp 362 slides upward on the ramp 370 until the ridge 364 is above the ridge 376, at which point the wall 142C rebounds and ridge 376 overlaps the ridge 364 to create the snap-fit connection between the timer 118 and the base 106. The timer 118 is also connected to the base 106 via fastening members 217 (shown in phantom in FIG. 2), which extend through the coupler 216 and into the openings 382 (FIG. 3) in the base 106.

The snap-fit connection between the timer 118 and the base 106, and between the motor 112 and the base 106, may mate the coupling component of the outlet 244 of the timer 118 with the coupling component of the inlet 262 of the motor 112. As described above, the timer 118 is connected to the motor 112 by inserting the tabs 250A, 250B in the slots 304A, 304B and rotating the timer 118 ninety degrees (90°). Alternatively, however, a fluid-tight connection may be established by aligning the outlet 244 and the inlet 262 and then connecting the timer 118 and the motor 112 to the base 106, such that the snap-fit connections mate the outlet 244 with the inlet 262.

The water sprinkler 100 may be manufactured according to the following process. First, the outlet 244 of the timer 118 is fluidly connected to the inlet 262 of the motor 112 to form a fluid-tight connection therebetween. As described above, the fluid-tight connection is achieved by inserting the tabs 250A, 250B into the slots 304A, 304B and rotating the timer 118 approximately ninety degrees. Next, the timer 118 and motor 112 as a unit are connected to the base 106 with a snap-fit connection between the retention structure 154 and the retention structure 218, and a snap-fit connection between the retention structures 160A, 160B and the retention structures 276A, 276B. The outlet 244 remains mated with the inlet 262 when the snap-fit connections exist between the timer 118 and the base 106 and the motor 112 the base 106. Next, the coupler 216 is fastened to the base 106 to further secure the timer 118 to the base 106. Furthermore, the coupler 358 is connected to the base 106 to further secure the motor 112 to the base 106. Finally, the distributor 124 is fluidly coupled to the outlet 274 of the motor 112 and is mechanically connected to the drive member 298.

The water sprinkler 100 may be operated according to the following process. First, the garden hose 130, is connected to the inlet 214 of the timer 118 via the internally threaded coupling 400. Next, the dial 226 is moved to select a predetermined time period, and the water sprinkler 100 is placed in the predetermined area. Thereafter, water is supplied to the inlet 214 via the garden hose 130. The timer 118 enables water flowing through the inlet 214 to flow to the outlet 244 because the timer 118 is in the "on" mode. From the outlet 244 of the timer 118 the water flows through the inlet 262 and then the outlet 274 of the motor 112. Within the motor 112, the flow of the water causes the drive member 298 to oscillate, which in turn causes the distributor 124 to oscillate. From the outlet 274 of the motor 112 the water flows through the inlet 310 of the distributor 124 and then exits the distributor 124 through the outlets 316 onto the predetermined area.

The device described herein has been illustrated and described in detail in the figures and foregoing description, the same should be considered as illustrative and not restrictive in character. It is understood that only the preferred embodiments have been presented and that all changes, modifications, and further applications that come within the spirit of the device described herein are desired to be protected.

What is claimed is:

1. A water sprinkler, comprising:

a base;

a timer mechanism having a timer inlet and a timer outlet, said timer mechanism being configured to operate in (i) a first mode in which fluid is allowed to pass between said timer inlet and said timer outlet, and (ii) a second mode in which fluid is prevented from passing between said timer inlet and said timer outlet;

a motor having a motor inlet, a motor outlet, and a drive member, said motor configured to move said drive member in response to fluid passing from said motor inlet to said motor outlet; and a spray member coupled to said motor outlet, said spray member configured to move in response to movement of said drive member, wherein said base includes a first base retention structure and a second base retention structure, wherein said timer mechanism includes a timer retention structure configured to cooperate with said first base retention structure to create a first snap-fit connection between said timer mechanism and said base, wherein said motor includes a motor retention structure configured to cooperate with said second base retention structure to create a second snap-fit connection between said motor and said base, wherein said timer outlet defines a first coupling component, and wherein said motor inlet defines a second coupling component configured to mate with the first coupling component.

2. The water sprinkler of claim 1, wherein:

said first coupling component is mated with said second coupling component when both (i) said first snap-fit connection exists between said timer mechanism and said base, and (ii) said second snap-fit connection exists between said motor and said base.

3. The water sprinkler of claim 1, wherein:

said timer mechanism includes a timer end cap, said timer end cap defines said timer outlet, said motor includes a motor end cap, and said motor end cap defines said motor inlet.

4. The water sprinkler of claim 1, wherein:

said base defines a cavity, said timer mechanism is retained at least partially within said cavity when said first snap-fit connection exists between said timer mechanism and said base, and said motor is retained at least partially within said cavity when said second snap-fit connection exists between said motor and said base.

5. The water sprinkler of claim 1, wherein:

said base further includes a first set of partition walls located within said cavity that defines a first sub-cavity in which said timer mechanism is at least partially positioned, and said base further includes a second set of partition walls located within said cavity that defines a second sub-cavity in which said motor is at least partially positioned.

6. The water sprinkler of claim 5, wherein:

said first base retention structure is secured to said first set of partition walls, and said second base retention structure is secured to said second set of partition walls.

7. The water sprinkler of claim 5, wherein:

said first set of partition walls includes a motor-facing wall, said motor-facing wall defines a passage extending therethrough, and said first coupling component extends through said passage.

8. The water sprinkler of claim 7, wherein said second coupling is at least partially located within said passage.

9. The water sprinkler of claim 1, wherein:

said motor inlet is configured to fluidly couple to said timer outlet in response to rotation of said first coupling component relative to said second coupling component while said first coupling component is mated to said second coupling component.

10. The water sprinkler of claim 1, wherein:

said motor inlet is configured to fluidly couple to said timer outlet in response to about a ninety (90°) rotation of said first coupling component relative to said second coupling component while said first coupling component is mated to said second coupling component.

11. The water sprinkler of claim 1, wherein:

said spray member includes a spray member inlet and a plurality of spray member outlets, and said spray member inlet is coupled to said motor outlet.

12. The water sprinkler of claim 11, wherein said motor is configured to oscillate said spray member in a repeating pattern of movement in response to fluid passing from said motor inlet to said motor outlet.

* * * * *